US010204603B2

(12) United States Patent
McReynolds

(10) Patent No.: US 10,204,603 B2
(45) Date of Patent: Feb. 12, 2019

(54) TREMOLO LOCK FOR ELECTRIC GUITAR

(71) Applicant: Matthew McReynolds, San Antonio, TX (US)

(72) Inventor: Matthew McReynolds, San Antonio, TX (US)

( * ) Notice: Subject to any disclaimer, the term of this patent is extended or adjusted under 35 U.S.C. 154(b) by 0 days.

(21) Appl. No.: 15/814,663

(22) Filed: Nov. 16, 2017

(65) Prior Publication Data

US 2018/0137842 A1 May 17, 2018

Related U.S. Application Data

(60) Provisional application No. 62/422,649, filed on Nov. 16, 2016.

(51) Int. Cl.
*G10D 3/14* (2006.01)
*G10D 1/08* (2006.01)

(52) U.S. Cl.
CPC ..... *G10D 3/146* (2013.01); *G10D 1/085* (2013.01)

(58) Field of Classification Search
CPC ..... G10D 3/146
See application file for complete search history.

(56) References Cited

U.S. PATENT DOCUMENTS 4,697,493 A * 10/1987 Ralston ..... G10D 3/146 84/313
4,892,025 A * 1/1990 Steinberger ..... G10D 3/146 84/313
5,438,902 A * 8/1995 Baker ..... G10D 3/14 84/312 R
5,986,192 A * 11/1999 Wingfield ..... G10D 3/146 84/313
6,812,389 B2 * 11/2004 Trooien ..... G10D 3/146 84/312 R
6,943,284 B2 * 9/2005 Didan ..... G10D 3/146 84/312 R
7,145,065 B2 * 12/2006 Geier ..... G10D 3/146 84/313
7,427,703 B2 * 9/2008 Geier ..... G10D 3/146 84/307
8,252,999 B2 * 8/2012 Deck ..... G10D 3/146 84/313
9,029,671 B1 * 5/2015 Smith ..... G10D 1/085 84/313
9,502,010 B1 * 11/2016 Cardozo ..... G10D 3/146
9,697,809 B2 * 7/2017 Cardozo ..... G10D 3/146
2006/0005687 A1 * 1/2006 Minakuchi ..... G10D 3/146 84/313
2018/0137842 A1 * 5/2018 McReynolds ..... G10D 3/146

* cited by examiner

*Primary Examiner* — Robert W Horn
(74) *Attorney, Agent, or Firm* — Bernhard P. Molldrem, Jr.

(57) ABSTRACT

A tremolo block combines a guitar tremolo arm with a cam locking mechanism so that when the arm is swung to a position for actuating the tremolo the locking pin on the cam is away from a mating socket or receiver, but when the arm is swung the other way, the cam pushes the pin into the locking socket so the tremolo is inactive and the string tension does not change. The position of the receiver or socket can be easily adjusted by the guitarist so that the string tension when the bridge is floating matches the string tension (and tuning) when the bridge is locked.

3 Claims, 3 Drawing Sheets

12
10
24
20
22
18
16
14
12
28
14
18

12
10
14

12
10
28
22
14

12
22
14

12
10
34
42
14
18
40
44

30
32
10
12
44
40
42
14

32
36
22
28
40
10
14

TREMOLO LOCK FOR ELECTRIC GUITAR

Priority is claimed under 35 U.S.C. 119(e) of provisional application Ser. No. 62/422,649, filed Nov. 16, 2016, the disclosure whereof is incorporated by reference.

BACKGROUND OF THE INVENTION

This invention is directed to a tremolo system on a guitar in which a tremolo arm can swing out to a tremolo position in which the associated bridge or tremolo block is floating (allowing the guitar player to bend the notes) and can swing back to a lock position where the bridge or block is locked and does not move.

Tremolo is a well known feature in the music world, and many of these have names such as Steinberger, Floyd Rose and Kahler, and are found on many Fender guitars. Basically, the guitar is provided with a "floating bridge", where the strings terminate. The bridge is on a "tremolo block" that fits into an opening in the guitar body and is pivoted horizontally, with a set of springs mounted to one side of the pivot to balance the tension of the strings on the other side of the pivot. A tremolo arm extends out from the block so the player can move the bar down and up to relieve some of the tension on the strings and change the pitch to bend the notes.

The invention here involves a simple system for the tremolo block that combines the tremolo arm with a cam locking mechanism so that when the arm is swung to a position for actuating the tremolo the locking pin on the cam is away from a mating socket or receiver, but when the arm is swung the other way, the cam pushes the pin into the locking socket so the tremolo is inactive and the string tension doesn't change. The position of the receiver or socket can be easily adjusted by the guitarist so that the string tension when the bridge is floating matches the string tension (and tuning) when the bridge is locked.

SUMMARY OF THE INVENTION

The tremolo system has a back plate that mounts onto the back of the guitar body and a bridge block or tremolo block with a top plate that mounts onto the top face of the guitar body. The tremolo arm is generally L-shaped and pivots on a vertical axis, fitting into a bore on one side of the tremolo block, so the tremolo is part of the bridge block. The tremolo arm rotates a cam that moves down to lock and engage a receiver that is adjustably mounted on the back plate. The tremolo arm is rotated the other way to unlock the block to a floating position where the guitarist can use the tremolo arm to bend the notes.

BRIEF DESCRIPTION OF THE DRAWING

FIGS. 5, 6, 7, and 8 are a perspective view, side elevation, front elevation, and bottom plan of the tremolo block of the system of the present invention.

FIG. 9 is an exploded assembly view thereof.

FIG. 10 is an inverted view featuring the back side or bottom side of the tremolo assembly of one embodiment of this invention.

FIG. 11 is a cross sectional view thereof.

FIG. 12 is a top perspective view thereof.

Figure 1:
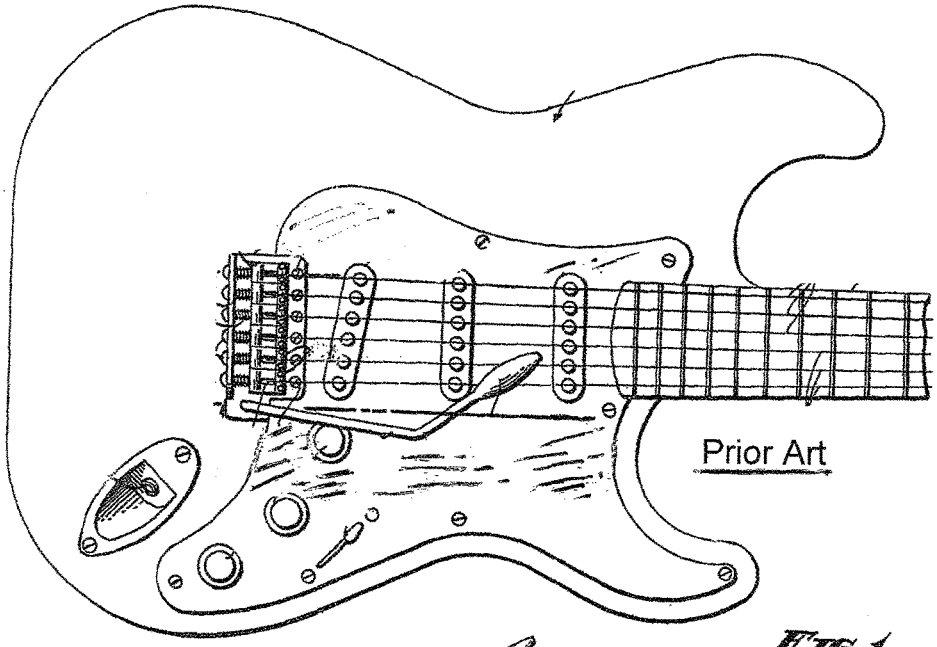
FIGS. 1, 2, 3, and 4 are a top plan, cross section (at line 2-2), bottom view (at line 3-3) and side cross section (at line 4-4), of an earlier guitar, showing a prior-art tremolo system. This corresponds to the guitar tremolo that is described and illustrated in Fender U.S. Pat. No. 2,741,146 (Apr. 10, 1956), and the reference numbers on these views relate to the description in that patent.
Figure 2:
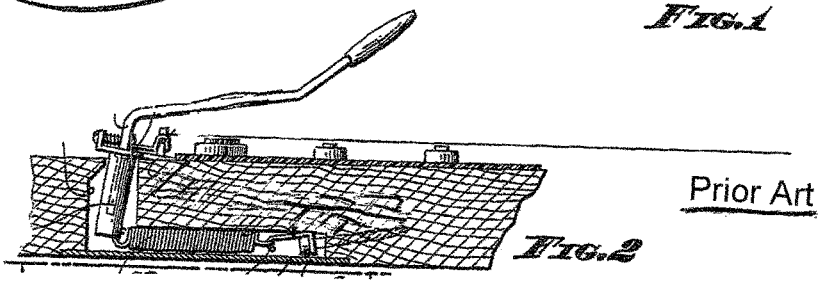
Figure 3:
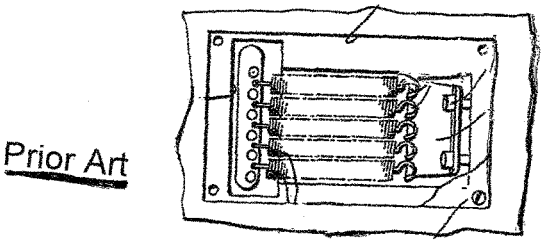
Figure 4:
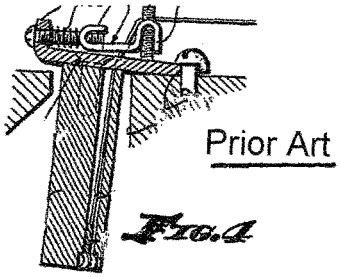
Figures 5, 6, 7, 8, 9:
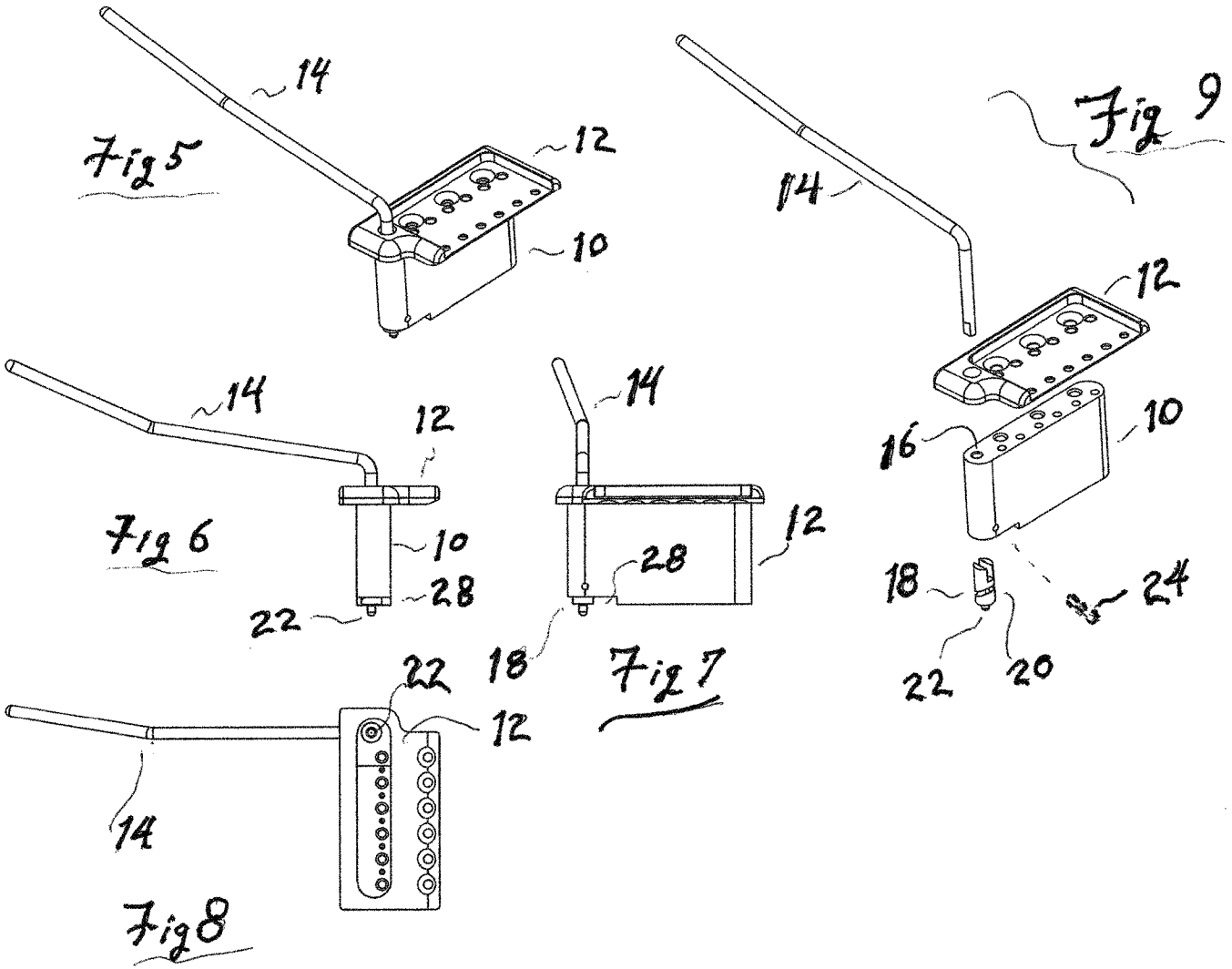
FIGS. 5 to 12 illustrate the tremolo system of the present invention, and the reference numbers used therein relate to the following description and not to the aforesaid Fender patent.

These views omit the guitar body in which they are mounted, the tremolo tension springs, guitar strings, and bridge saddles, but the person of ordinary skill familiar with tremolo systems would understand how the illustrated tremolo system components would be positioned with those omitted items into the guitar body.

DETAILED DESCRIPTION OF A PREFERRED EMBODIMENT

FIGS. 1 to 4 show the basic positioning of a prior-art tremolo system within an electric guitar, where the tremolo bar or tremolo arm can be moved to bow the floating bridge to change the pitch of the six guitar strings. These typically include some mechanism to hold the block in a locked position where the pitches do not change, so that the guitarist can switch between one mode and the other. The reader is referred to the numerous patents and articles directed to guitar tremolo systems.

The improvements described here and illustrated in FIGS. 5 to 12 are for an improved tremolo system with a lock actuated by swinging the tremolo arm between an unlocked (floating) and locked positions, and where the lock anchor or receiver holds the string tension the same when the tremolo feature is locked and when it is floating.

Referring first to FIGS. 5 to 9, a tremolo block or bridge block 10 is shown as elongated left to right (transversely to the guitar body) and vertically (through the thickness of the guitar body). A top cover or top plate 12 mounts onto the top of the block 10 and has provisions for mounting the bridge saddles (not shown) and for attaching to the top of the guitar body, and has six bores from left to right for receiving the body end of the guitar strings. An L-shaped tremolo bar or tremolo arm 14 is designed to pivot on a vertical axis with a pivot end extending down into a bore 16 in one side of the tremolo block 14. A generally cylindrical cam 18 is fitted into the lower part of this bore 16 and has a spiral cam groove 22 formed in it. The cam 18 here has se or pin 22 projecting out the bottom of the block 10. A cam pin 24 is fitted into a horizontal opening in the block 1 and this engages the spiral groove 22 so that when the arm 14 moves to the lock position the cam 18 descends, and when the arm 14 moves the other way the cam 18 rises. Note that a groove in the upper end of the cam 18 mates with a flattened lower end of the tremolo arm 14 to hold one another in rotational engagement.

The block 10 has a notch or shoulder 26 at the end where the cam 18 is located, to allow space to accommodate an anchor or receiver that projects up from the back plate of the tremolo system, as will now be described.

Figures 10, 11, 12:
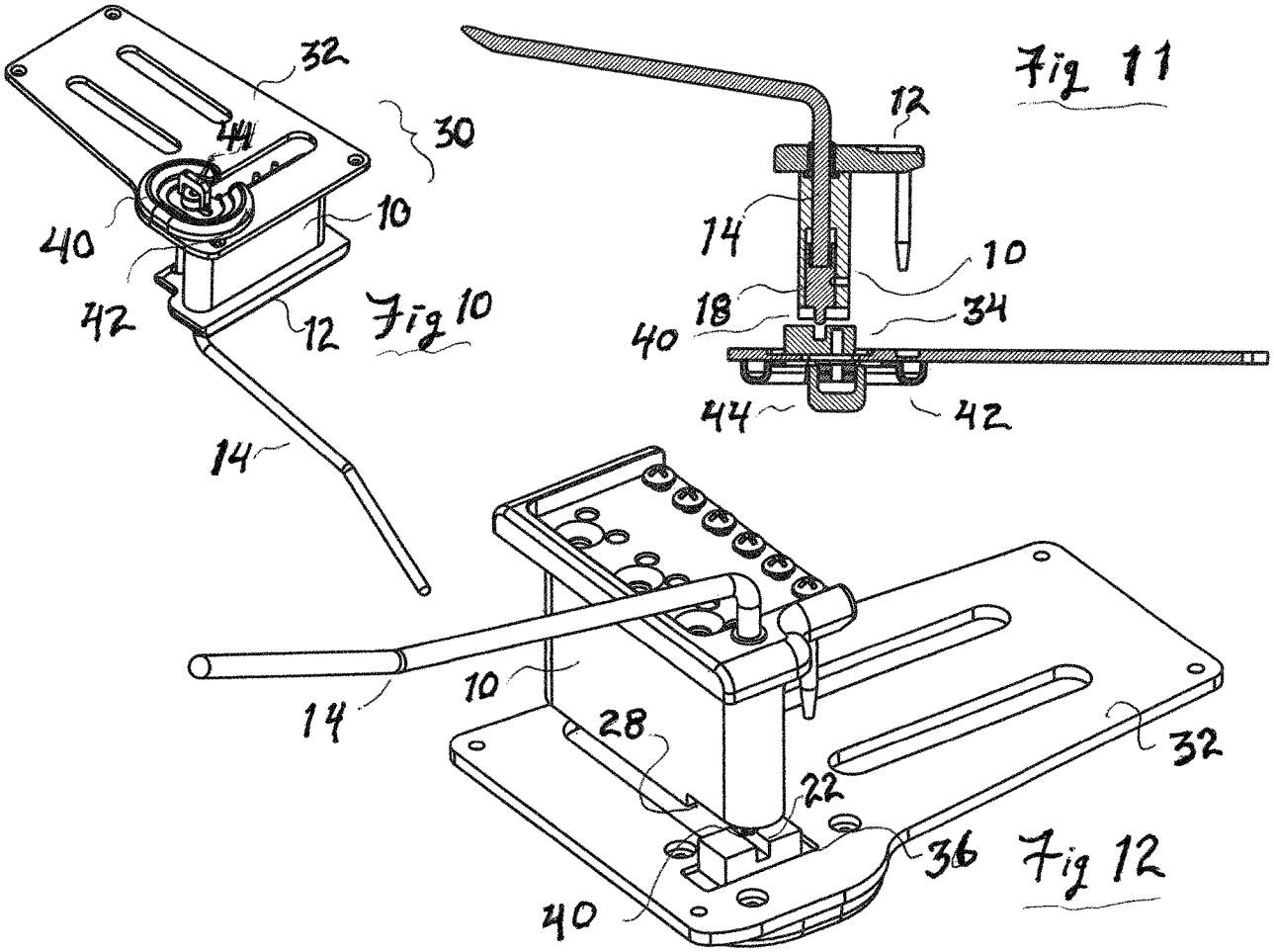

FIGS. 10 to 12 illustrate the tremolo assembly 30 that includes the above-described block 10 and tremolo arm 14, with FIG. 10 being an inverted view featuring the back plate, FIG. 11 being a cross section and FIG. 12 being a top perspective view.

The tremolo assembly has a back plate 32 that mounts onto the back side of the guitar body over the cutout (not shown) in the body to accommodate the tremolo block and associated tension springs (not shown). Here the back plate is shown with elongated slots to access the lower side of the tremolo block 10 and to access the tension springs, and bolt holes to facilitate attachment to the guitar body. A receiver block 34 is adjustably seated in a channel or slot 36 that is oriented in the axial direction (parallel to the guitar strings and neck). A wing bolt 38 screws into the body of the receiver block 34. This is loosened to allow the player to adjust the position of the block 34 and tightened to hold the receiver block in place in the slot 36. There is a transverse cut or slot 40 in the receiver block into which the nose or pin 22 of the cam 18 seats when the tremolo is in the lock position. This position may change depending on the tension on the guitar strings, which affects the floating position of the tremolo block 10. Accordingly, the guitarist can loosen the wing bolt 38 to move the receiver block 34 foreward or back in the slot so that its position matches the position of the nose or pin 22 of the tremolo lock cam 18. That is the position of the cam lock receiver block is adjusted so that the guitar strings remain tuned the same when the tremolo is floating or locked (i.e., floating tension equals locked tension), so that the guitar is in tune whether the tremolo is on or off.

Also included is a generally C-shaped cushion 42, formed of a yieldable, rubbery material and positioned on the back plate 30 around the head of the wing bolt 38. This keeps the head of the wing bolt from protruding into the abdomen or chest of the guitarist when playing. The wing bolt also has a swing-down grip member 44 that lies flat against the back plate when not needed for adjustment of the receiver block position In this arrangement the guitar easily changes from floating (tremolo) to locked, and the position of the locking receiver block 34 can be easily adjusted any time that the guitar is re-tuned. The adjustment does not require any wrench or any other tool.

In this arrangement, the cam 18 (which is positioned within the tremolo block) and receiver block 34 (which is firmly secured to the tremolo system back plate) form a solid connection between the bridge and the guitar body when the tremolo is locked, so that the vibrations of the strings are conveyed to the guitar body, and allow the sound to incorporate the guitar's wood-mode resonances.

The tremolo block, top plate, back plate and other parts can be formed of a durable metal fo from a high-performance plastic or synthetic material.

Many possible modifications and variations of the closeable and lockable climbing stick would occur to persons of skill in the art, without departing from the scope and spirit of the invention, as defined in the claims.

What is claimed is:

1. A tremolo system for a guitar which comprises a solid generally rectangular bridge block or tremolo block having a bore on one side thereof; an L-shaped tremolo arm having a pivot end extending vertically into said bore; a rotary cam member within said bore and arranged so as to descend and rise in said bore as said tremolo bar is rotated between a floating position and a locked position, wherein said cam includes a nose portion that projects below a lower side of said tremolo block; a back plate that mounts onto a back side of the body of the guitar; and a receiver block that is adjustably mounted on said back plate below said tremolo block and having a transverse cutout to receive said nose portion of said cam; and an adjustable fastener that holds said receiver block in place on said back plate but permits a guitarist to release the receiver block to permit the position of the receiver block to be adjusted axially on the guitar.

2. The tremolo system as recited in claim 1, wherein said receiver block is rectangular and is positioned in an axially oriented channel in said back plate.

3. The tremolo system as recited in claim 1, wherein said adjustable fastener includes a wing bolt having a swing down grip member on its head, and a C-shaped cushion positioned on said back plate around the head of said wing bolt.

* * * * *